United States Patent [19]

Hayek et al.

[11] 4,139,477

[45] Feb. 13, 1979

[54] FABRIC CONDITIONING COMPOSITIONS

[75] Inventors: Mason Hayek, Wilmington; Gordon B. Robbins, Claymont; Oliver Yeaton, Wilmington, all of Del.

[73] Assignee: E. I. Du Pont de Nemours and Company, Wilmington, Del.

[21] Appl. No.: 887,331

[22] Filed: Mar. 16, 1978

[51] Int. Cl. ..... D06M 13/34

[52] U.S. Cl. ..... 252/8.8; 252/8.6; 260/567.6 M; 428/279

[58] Field of Search ..... 252/8.8, 8.6; 428/279; 260/567.6 M

[56] References Cited

U.S. PATENT DOCUMENTS

| | | | |
|---|---|---|---|
| 3,578,591 | 5/1971 | Lazaridis et al. | 252/8.6 |
| 3,793,196 | 2/1974 | Okazaki et al. | 252/8.8 |
| 3,862,045 | 1/1975 | Sato et al. | 252/8.8 |
| 3,914,496 | 10/1975 | Jorek et al. | 252/8.6 |

FOREIGN PATENT DOCUMENTS

| | | | |
|---|---|---|---|
| 571219 | 2/1959 | Canada | 428/279 |

*Primary Examiner*—William E. Schulz

[57] ABSTRACT

Solid fabric conditioner compositions comprising quaternary ammonium softener compound and high molecular alcohol, said compositions imparting antistatic properties and improving water wicking of fabrics.

11 Claims, No Drawings

FABRIC CONDITIONING COMPOSITIONS

BACKGROUND OF THE INVENTION

1. Technical Field

This invention relates to compositions for the conditioning of fabrics in a laundry dryer. The compositions are applied to a substrate and are transferable to fabrics during the operation of a standard laundry dryer.

2. Background Art

Certain chemical compounds have long been known in the art to possess the desired quality of imparting softness to textile fibers. The quality of softness or being soft is well defined in the art and, as used herein, means that quality of a treated fabric whereby its handle or texture is smooth, pliable and fluffy and not rough or scratchy to the touch. Known generally as "softening agents", "fabric softeners" or "softeners", these compounds have long been used in the home laundry and in the textile industry to soften fabrics. Additionally, many of these compounds act to reduce the "static cling" of the treated fabric. Static cling is generally the phenomenon of one fabric adhering to another or to parts of itself as a result of static electrical charges located on the surface of the fabric. It can also involve the adherence of lint, dust and other similarly undesired substances to a fabric due to the static charges. It is noticeably present in fabrics that are freshly washed and dried in an automatic dryer. Softening and reducing the static cling of a fabric makes the fabric more comfortable when worn. In addition, such treated fabrics are easier to iron and have fewer hard-to-iron wrinkles. The prior art suggests the use of a softening agent coated onto a flexible substrate for use as a dryer-added softening composition (See U.S. Pat. Nos. 3,686,025 and 3,632,396).

However, the prior art compositions have serious disadvantages such as staining the treated fabric or causing a reduction in the tendency of the fabric to wick water.

It is the object of this invention to provide a fabric conditioning composition which not only softens the fabric and reduces static cling, but also minimizes staining and maintains the tendency of the fabric to wick water.

DISCLOSURE OF THE INVENTION

This invention relates to a fabric conditioning composition which can be applied to a substrate and used for conditioning fabrics in a laundry clothes dryer. The substrate can be cellulosic or synthetic, such as a multiply paper, a nonwoven cloth, spun-bonded polyester or polyurethane. The term "cloth" herein shall mean a woven or nonwoven fabric or cloth used as a substrate in order to distinguish said component from the term "fabric" which is intended herein to mean the textile fabric which is desired to be conditioned.

The conditioning compositions of this invention find particular application in effectively conditioning fabrics in a standard automatic clothes dryer. Preferably, the conditioning composition is applied to paper or nonwoven cellulosic or synthetic cloth and made up into a tubular roll or individual sheets. A desired length of the treated substrate is torn off the roll or a sheet removed from its package and placed in the clothes dryer wherein the fabrics to be treated have been loaded. The dryer is then operated in customary fashion and softening occurs as the fabrics directly contact the treated substrate whereby the conditioning composition is transferred from the substrate to the fabric. The necessary contact between the fabric and the treated substrate is effected by the spinning or tumbling action of a conventional automatic clothes dryer.

The fabric conditioning composition consists essentially of a quaternary ammonium salt and a mixture of a high molecular weight alcohol and hydrocarbon. The quaternary ammonium salt has the general formula

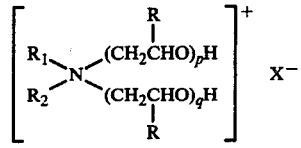

where R is H or $CH_3$; $R_1$ is an alkyl group containing from 12 to 24 carbon atoms; $R_2$ is an alkyl group containing from 1 to 4 carbon atoms; $p$ and $q$ are each at least 1 and the sum of $p$ plus $q$ averages from 2 to 20 and X is an anion.

In the quaternary ammonium salts herein, the anion X provides electrical neutrality. The nature of the anion X is thus of no consequence to the present invention and any anion is useful herein. Useful anions include halides such as bromide, chloride, fluoride or iodide, methyl sulfate, ethyl sulfate, acetate, sulfate, carbonate and the like. Methyl sulfate is a particularly preferred anion herein.

The quaternary ammonium salt is conveniently prepared by ethoxylation or propoxylation of a long-chain fatty alkyl amine containing from 12 to 24 carbon atoms under alkaline conditions to form the requisite poly(oxyalkylene) amine adduct, which is subsequently alkylated to the quaternary ammonium salt as described hereinafter in the examples.

As employed herein, alkyl is intended as including unsaturated compounds such as are present in alkyl groups derived from naturally occurring fats or oils. The term "tallow alkyl" refers to fatty alkyl groups derived from tallow. Fatty amines derived from tallow give rise to quaternary ammonium salts of the aforesaid formula wherein $R_1$ contains from 16 to 18 carbon atoms of which approximately half are monounsaturated. The term "coconut alkyl" refers to fatty alkyl groups from coconut oil. The coconut alkyl $R_1$ group contains from 12 to 16 carbon atoms and averages 13 carbon atoms. The term "arachidyl-behenyl alkyl" refers to fatty alkyl groups from fish oils, e.g., herring, menhaden and sardines, and certain vegetable oils, e.g., rapeseed and mustard seed. The arachidyl-behenyl alkyl $R_1$ group contains from 18 to 22 carbon atoms and has been saturated by hydrogenation.

While it is possible to prepare the quaternary ammonium salts using pure alkyl amines, for economic reasons raw materials with mixed alkyl groups are commonly employed. The use of such a mixture results in the formation of mixtures of quaternary ammonium salts and such mixtures are contemplated for use herein. A particularly preferred quaternary ammonium salt mixture herein is derived from hydrogenated tallowamine containing approximately 70% by weight of $C_{18}H_{37}$ alkyl and 30% by weight of $C_{16}H_{33}$ alkyl.

It is believed that the quaternary ammonium salt contributes significantly to the softening, antistatic and water wicking properties of the composition. The quaternary ammonium salt is generally a viscous liquid or soft waxy material.

In order to modify this material to make it adaptable for coating onto a substrate and to extend this relatively expensive material, it is combined with a mixture of high molecular weight alcohol and a co-distilling hydrocarbon, hereinafter referred to as an alcohol mixture. The alcohol is a mixture of from 60 to 70 wt % alcohol of the formula $C_nH_{2n+1}OH$, wherein $n = 18$ to 28, and from 30 to 40 wt % hydrocarbon. Alcohol-hydrocarbon mixtures containing more than 70 wt % high boiling alcohols are acceptable for use in this composition but because of their higher cost, they are not preferred. A mixture of 70 wt % alcohol and 30 wt % hydrocarbon is preferred. (Commercially available as ALFOL 20+ and ALFOL 22+ [Registered Trademark Continental Oil Co.]). The alcohol is commercially available as the co-distilling high boilers obtained from the production of alcohols by the polymerization of ethylene and is an off-white waxy solid with a melting range of 40° to 60° C.

The fabric conditioning composition is a mixture of approximately 20 to 65 wt % quaternary ammonium salt and 80 to 35 wt % alcohol mixture. The lower limit of quaternary ammonium salt is necessary to maintain the fabric conditioning properties of the composition. The lower limit of alcohol mixture is necessary to maintain the composition in a form suitable for application to a substrate. The composition is an off-white waxy solid with a melting range of 40° to 60° C. Thus, the composition is a solid at room temperature and therefore may be readily stored on the substrate without staining the package and may be handled by consumers without discomfort.

The fabric conditioning compositions of the invention are applied to the substrate using coating or impregnating techniques well known in the art. The substrate can be coated, for example, by padding techniques whereby the substrate is passed through a solution or dispersion of conditioning composition, the excess removed and the substrate allowed to dry. Similarly, the conditioning composition can be sprayed in known manner to provide a suitable coating. Hot-melt application or printing methods, i.e., flexographic or gravure, can be employed to provide a waxy coated substrate suited for softening tubmling fabrics in a clothes dryer.

The amount of conditioning composition carried by the substrate is an amount sufficient to provide the desired conditioning effect without substantial excess. The amount will vary in any given case and will depend, for example, upon the nature of the particular conditioning composition or substrate material and the type of conditioning effect desired. Generally, the amount of conditioning composition ranges from 100 to 350%, by weight based on the untreated substrate, the smaller amounts of conditioning agent being used on lightweight substrates, such as nonwoven cloths, e.g., spunbonded polyester, and the larger amounts on heavy substrates, such as multi-ply paper.

Preferred conditioning compositions consist of from 45 to 55 wt % alcohol mixture and from 45 to 55 wt % quaternary ammonium salt of the aforesaid formula wherein X is methyl sulfate, R is H, $R_1$ is tallow alkyl, $R_2$ is methyl, and the sum of $p + q$ equals from 10 to 16. These compositions are yellow waxy substances with good fabric conditioning properties. In particular, a composition consisting of 50 wt % alcohol mixture and 50 wt % quaternary ammonium salt as described wherein the sum of $p + q$ equals 16 is preferred.

More preferred compositions consist of from 75 to 40 wt % alcohol mixture and from 25 to 60 wt % quaternary ammonium salt of the aforesaid formula wherein X is methyl sulfate, R is H, $R_1$ is hydrogenated tallow alkyl, $R_2$ is methyl, and the sum of $p + q$ equals from 3 to 6. The use of hydrogenated tallow component in the composition results in a white waxy substance and it is believed that this lack of color assists in reducing staining of fabrics. It is also an economic advantage to use the lower molecular weight poly(oxyalkylenes) in that one obtains the same fabric conditioning properties using less weight of the quaternary ammonium salt which is significantly more expensive than the alcohol mixture. To optimize this economic advantage, one may use the more preferred compositions containing from 25 to 35 wt % quaternary ammonium salt. In particular, a composition containing 70 wt % alcohol mixture and 30 wt % quaternary ammonium salt as described wherein the sum of $p + q$ equals 5 is most preferred.

BEST MODE AND EXAMPLES

The conditioning compositions of this invention were prepared by the procedures given in Examples 1 to 4. Examples 5, 6 and 7 illustrate the utility of the compositions as conditioners in a conventional dryer.

EXAMPLE 1

(A) An ethoxylated tertiary amine was prepared by placing 140 g of hydrogenated tallowamine with a neutral equivalent of 268 (average molecular wt) in a 400 ml stainless steel bomb. The bomb was chilled in a carbon ice-acetone mixture, evacuated and refilled with nitrogen. The bomb was reevacuated and 100–105 g of ethylene oxide was introduced through condensation of the gas in the chilled bomb. The bomb was heated for 1 hour at 80° C., then for 1 hour at 90° C. and finally for 8 hours at 150°–155° C. to give a product which had no free >N—H bonds as indicated by examination of the near-infrared spectrum at 1.54–1.56 microns. The titration of basic nitrogen with nonaqueous perchloric acid solution indicated a neutral equivalent of 426 which corresponded to a hydrogenated tallowamine — 3.6 ethylene oxide adduct.

(B) In order to extend the polyoxyethylene chains, 276 g of the hydrogenated tallowamine — 3.6 ethylene oxide adduct prepared in (A) was placed in a flask and blanketed with a nitrogen atmosphere. To this, 0.50 g of a 50% dispersion of sodium hydride in mineral oil was added. Then, 38 g of ethylene oxide was added below the surface of the liquid at 140°–150° C. at such a rate that it was completely absorbed. The sodium of the sodium hydroxide was then neutralized by the addition of 0.62 ml glacial acetic acid. The resultant product possessed a neutral equivalent of 468 which corresponded to a hydrogenated tallowamine — 4.6 ethylene oxide adduct.

(C) Approximately 264 grams of the hydrogenated tallowamine — 4.6 ethylene oxide adduct of neutral equivalent 468 from (B) was stirred under a nitrogen blanket at 50° C. and quaternized by the dropwise addition of 6.3 g dimethyl sulfate at 50° to 70° C. to produce a nearly neutral waxy solid quaternary ammonium methyl sulfate salt.

(D) A composition of the invention was obtained by mixing 88 g of the quaternary ammonium salt produced in (C) with 198 g of a mixture of 70% even numbered saturated alcohols containing from 20 to 28 carbon atoms and 30% of the codistilling hydrocarbons as derived from alcohol manufacture by ethylene polymerization, said composition melting at 45°-60° C. This mixture formed a clear solution with a Gardner color of 5 and hardened to a waxy solid on cooling. The composition contained 30 wt % quaternary ammonium salt and 70 wt % alcohol mixture wherein the quaternary ammonium salt was of the formula

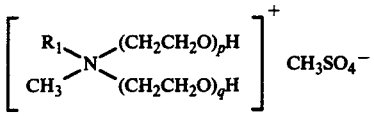

wherein $R_1$ is hydrogenated tallow alkyl, and $p + q$ equals 4.6.

EXAMPLE 2

(A) To 276 g of the hydrogenated tallowamine — 3.6 ethylene oxide adduct prepared in Example 1(A) was added 0.50 g of a 50% dispersion of sodium hydride in mineral oil. Ethylene oxide (200 g) was added at 140° to 150° C. Glacial acetic acid (0.62 ml) was then added to neutralize the sodium of the sodium hydride. The resultant product had a neutral equivalent of 650 and corresponded to a hydrogenated tallowamine — 8.7 ethylene oxide adduct.

(B) Approximately 400 g of the hydrogenated tallowamine — 8.7 ethylene oxide adduct prepared in (A) was quaternized with 76 grams of dimethyl sulfate by the procedure of Example 1(C).

(C) A composition of the invention was obtained by mixing 150 g of the quaternary salt of (B) with 225 g of the higher alcohol hydrocarbon mixture described in Example 1(D) to form a clear solution of Gardner color 6-7 which hardened to a waxy solid on cooling. The composition contained 40 wt % quaternary ammonium salt and 60 wt % alcohol mixture wherein the quaternary ammonium salt was of the formula

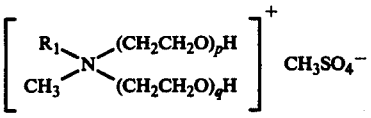

wherein $R_1$ is hydrogenated tallow alkyl, and $p + q$ equals 8.7.

EXAMPLE 3

(A) Approximately 486 grams of a tallowamine — 16 ethylene oxide adduct was quaternized with 60 g dimethyl sulfate by the procedure as described in Example 1(C) to form the corresponding quaternary ammonium methyl sulfate salt.

(B) A composition of the invention was obtained by mixing 100 g of the quaternary ammonium salt from (A) with 100 g of the higher alcohol hydrocarbon mixture described in Example 1(D) to form a clear solution of Gardner color 11 which hardened to a waxy solid on cooling. The resultant composition contained 50 wt % quaternary ammonium salt and 50 wt % alcohol mixture wherein the quaternary ammonium salt was of the formula

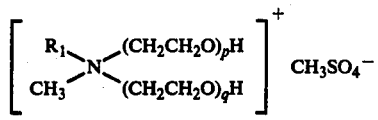

wherein $R_1$ is tallow alkyl, and $p + q$ equals 16.

EXAMPLE 4

(A) Approximately 316 g of cocoamine — 2 propylene oxide adduct of neutral equivalent 316 was agitated under a nitrogen atmosphere with 0.86 g of a 58% dispersion of sodium hydride in mineral oil. About 236 g of propylene oxide were added at 140°-150° C. The mixture was cooled and the sodium was neutralized with 4.1 g of toluene sulfonic acid hydrate. The resultant product had a neutral equivalent of 552 which corresponded to an adduct of cocoamine with 6 moles of propylene oxide.

(B) Approximately 240 g of the cocoamine — 6 propylene oxide adduct of (A) were quaternized with 53 g of dimethyl sulfate using the procedure of Example 1(C) to form the corresponding quaternary ammonium methyl sulfate salt.

(C) A composition of the invention was obtained by mixing 25 g of the quaternary ammonium salt of (A) with 75 g of higher alcohol — hydrocarbon mixture as described in Example 1(D) to form a clear solution which formed a waxy solid upon cooling. The composition contained 25 wt % quaternary ammonium salt and 75 wt % alcohol mixture wherein the quaternary ammonium salt was of the formula

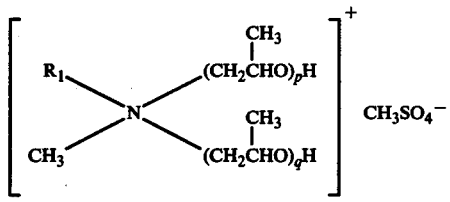

wherein $R_1$ is coca alkyl, and $p + q$ equals 6.

EXAMPLE 5

A hot-melt application of the composition of Example 3(B) was made on spun-bonded polyester which weighed 1.0 g per 99 square inches, to deposit 2.5 g of coating per 99 square inches.

The coated polyester was used for conditioning fabrics in a home dryer by placing the sheet in the dryer together with a wet fabric load, i.e., six pounds of mixed cotton towels and fabrics of synthetic fibers. The dryer was operated until the fabrics had dried and the fabrics were then held at 55-65% relative humidity for testing.

Fabric softness was evaluated by an experienced person feeling the fabrics and rated on a scale of 1 to 5, with 1 for the control, unsoftened fabric and 5 for the softest fabric. Cotton terrycloth towels and fabric of "DACRON" (Registered Trademark of E. I. du Pont de Nemours and Company) polyester staple fiber were evaluated.

The tendency of conditioned fabrics to wick water (a measure of the absorbency of fabrics) was judged by measuring the height to which water rose in a strip of fabric whose end was immersed in water. On a 1 inch × 7 inch (0.025 m × 0.18 m) strip of fabric a mark was placed 1 inch (0.025 m) from the end measured along the long side. A beaker was placed under the fabric and filled with water to the 1 inch (0.025 m) mark on the fabric, the water having been colored by the addition of 0.25% "MONSTRAL" (Registered Trademark of E. I. du Pont de Nemours and Company) Blue BWD (Pigment Blue 15). The test fabric was held in the water for 3 minutes, removed and air dried. The wicking action of the fabric was reported as the height of coloration of the fabric above the 1 inch (0.025 m) mark.

The static propensities of the test fabrics were determined by measurement of the electrical resistivities of the fabrics at 20% relative humidity, using a Keithley 610C Electrometer with a Keithley 240A High Voltage Supply, according to AATCC Test Method 76-1975. Results are reported as the logarithm of the surface electrical resistivity (ohms/square) designated "Log R".

The results obtained for the conditioned fabrics after one drying cycle and after the same fabrics were successively washed and dried in the presence of the fabric conditioners for a total of three drying cycles are given below:

| Property | Fabric Conditioner 1 Cycle | Fabric Conditioner 3 Cycles | Control No Conditioner 1 Cycle |
|---|---|---|---|
| Softness | | | |
| Towels | 1.7 | 1.7 | 1.0 |
| Polyester fabric | 4.0 | 3.0 | 1.0 |
| Wicking, inches | 6.1 | 6.0 | 4.8 |
| Log R | | | |
| Nylon fabric | 11.9 | 12.0 | 15.4 |
| Polyester fabric | 13.2 | 13.4 | 15.0 |

The results show that use of the fabric conditioner in the dryer loads resulted in softening, improved wicking action beyond that of the untreated fabrics and lowered electrical resistivity. The "Log R" for cotton broadcloth fabric at 20% relative humidity is approximately 13.6 (a standard of low static propensity) and the lower values for the conditioned fabrics of synthetic fibers indicate that these fabrics would be expected to develop less static charge (therefore less "static cling") than cotton at the same humidity. Note that the decrease in electrical resistivity between the control and the Nylon fabric after 3 cycles was 3.4 log R units which is a 2500 fold decrease in electrical resistivity as expressed in ohms/square.

EXAMPLE 6

A composition as prepared in Example 3(B) was applied to spun-bonded polyester in a commercial scale operation, using a hot-melt coater at 65° C. (150° F.) and coating at approximately 183 m per minute (600 feet per minute). The amount of conditioner applied varied between 191% and 202% of the weight of polyester. Portions of coated polyester were evaluated for softening, water wicking and antistatic action by drying 5-lb loads of mixed fabrics in the presence of either 0.22 m × 0.28 m (9 inch × 11 inch) or 0.18 m × 0.28 m (7 inch × 11 inch) sheets of coated polyester. The smaller sheets allowed judgment of the performance of conditioner which would be expected had the pickup of conditioner in the coating been approximately 150% instead of approximately 200%. Test dryer loads were run for 1, 3 and 5 wash-dry cycles. For comparison, a series was run without any conditioner. The averages for tests on three fabrics of each type are given below:

| Sheet Size | Cycles | Softness Towels | Softness "DACRON" |
|---|---|---|---|
| 9" × 11" (0.22 m × 0.28 m) | 1 | 1 | 5 |
| | 3 | 2 | 3 |
| | 5 | 3 | 5 |
| 9" × 11" (0.22 m × 0.28 m) | 1 | 1 | 4.5 |
| | 3 | 2 | 3 |
| | 5 | 3 | 5 |
| 7" × 11" (0.18 m × 0.28 m) | 1 | 1 | 4 |
| | 3 | 3.5 | 2 |
| | 5 | 2.5 | 3.5 |
| 7" × 11" (0.18 m × 0.28 m) | 1 | 1 | 3 |
| | 3 | 3.5 | 2.5 |
| | 5 | 2.5 | 3.5 |
| None | 1 | 1 | 1 |
| | 3 | 1 | 1 |
| | 5 | 1 | 1 |

| Wicking, Inches | | | Low R, 20% RH | |
|---|---|---|---|---|
| Towels | Nylon | "DACRON" | Nylon | "DACRON" |
| — | 1.7 | 2.8 | 12.5 | 15.0 |
| — | 1.3 | 3.2 | 13.7 | 14.1 |
| 3.5 | 1.5 | 3.1 | 12.6 | 15. |
| — | 1.6 | 2.7 | 14.1 | 14.1 |
| — | 1.6 | 2.7 | 14.5 | 13.7 |
| 3.2 | 1.4 | 2.5 | 12.6 | 14.9 |
| — | 1.5 | 2.1 | 11.7 | 15.1 |
| — | 1.5 | 3.0 | 13.7 | 14.8 |
| 2.2 | 1.5 | 2.9 | 14.8 | 15.8 |
| — | 1.6 | 3.3 | 12.7 | 14.5 |
| — | 1.3 | 3.0 | 12.5 | 15.0 |
| 3.4 | 1.3 | 3.1 | 12.4 | 14.7 |
| — | 1.6 | 2.1 | 15.7 | 15.5 |
| — | 1.3 | 2.0 | 16.3 | 16.2 |
| 3.5 | 2.2 | 2.2 | 16.2 | 16.0 |

Thus, softening of towels generally increased with the number of dryer cycles in which the fabric conditioner was used and fabrics of "DACRON" showed a high degree of softening even after one cycle. In this series of tests the wicking action of cotton towels and fabrics of Nylon and "DACRON" were equivalent to or greater than that of untreated fabrics, an effect contrary to the reduction of wicking action found with some commercial fabric softeners. The synthetic fiber fabrics showed electrical resistivity sufficiently below those of untreated fabrics that no static cling would be expected with the use of the conditioner in a dryer.

EXAMPLE 7

Three fabric conditioners A, B and C were coated onto spunbonded polyester as hot melts to deposit 1.6, 2.1 and 2.1 g of the respective conditioner per 99 sq in of the substrate.

Sample A: Same as that of Example 3(B).

Sample B: A 1:2 blend of the quaternary ammonium salt and alcohol-hydrocarbon mixture of Example 3(B).

Sample C: Same as that of Example 1(D).

The amounts of conditioner coated onto the substrate were approximately proportional to the amounts of quaternary ammonium salts in the products. The coated pieces of polyester, each 0.22 m × 0.28 m (9 inches × 11 inches) were tested as conditioners in a home dryer containing 5-lb mixed loads of fabrics. Conditioners A and B were tested in three successive wash-dry cycles and Conditioner C was tested in two successive wash-dry cycles.

Ratings of the conditioners, carried out as in the previous examples gave the following data on cotton towels:

| Conditioner | Cycles | Softness | Water Wicking, Inches |
|---|---|---|---|
| A | 3 | 4–3 | 4.0 |
| B | 3 | 3–2 | 5.5 |
| C | 2 | 5 | 4.6 |
| None | 1 | 1 | 6.0 |

The results of testing showed that product C produced maximum softness, and wicking action on towels was only slightly reduced versus that for towels without conditioner.

We claim:

1. A fabric conditioning composition consisting essentially of (a) from 20 to 65 wt % of a quaternary ammonium salt of the formula

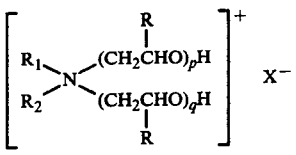

wherein X is any anion and R is H or $CH_3$, $R_1$ is an alkyl group containing from 12 to 24 carbon atoms, $R_2$ is an alkyl group containing from 1 to 4 carbon atoms, and $p + q$ equals from 2 to 20; and (b) from 35 to 80 wt % of a mixture of high molecular weight alcohol and hydrocarbon.

2. The fabric conditioner of claim 1 in which the mixture of high molecular weight alcohol and hydrocarbon is from 60 to 70 wt % of an alcohol of the formula $C_nH_{2n+1}OH$ wherein $n$ is from 18 to 28 and from 30 to 40 wt % hydrocarbon.

3. The fabric conditioner of claim 2 in which the mixture of high molecular weight alcohol and hydrocarbon is 70 wt % alcohol and 30 wt % hydrocarbon.

4. The fabric conditioning composition of claim 2 in which (a) the quaternary ammonium salt is from 45 to 55 wt % of the composition and R is H, $R_1$ is tallow alkyl, $R_2$ is methyl, and the sum of $p + q$ is from 10 to 16; and (b) the mixture of high molecular weight alcohol and hydrocarbon is from 45 to 55 wt % of the composition.

5. The fabric conditioning composition of claim 4 in which (a) the quaternary ammonium salt is 50 wt % of the composition and the sum of $p + q$ is 16, and X is methyl sulfate, and (b) the mixture of high molecular weight alcohol and hydrocarbon is 50 wt % of the composition.

6. The fabric conditioning composition of claim 2 in which (a) the quaternary ammonium salt is from 25 to 60 wt % of the composition and R is H, $R_1$ is hydrogenated tallow alkyl, $R_2$ is methyl, and $p + q$ is from 3 to 6; and (b) the mixture of high molecular weight alcohol and hydrocarbon is from 40 to 75 wt %.

7. The fabric conditioning composition of claim 6 in which the quaternary ammonium salt is from 25 to 35 wt % of the composition.

8. The fabric conditioning composition of claim 7 in which (a) the quaternary ammonium salt is 30 wt % of the composition and the sum of $p + q$ is 5 and X is methyl sulfate, and (b) the mixture of high molecular weight alcohol and hydrocarbon is 70 wt % of the composition.

9. The fabric conditioning composition of claim 1 as applied to a suitable substrate.

10. The fabric conditioning composition of claim 1 as applied to a polyester substrate.

11. The fabric conditioning composition of claim 1 as applied to a cellulosic substrate.

* * * * *